US005933045A

United States Patent [19]

Audy et al.

[11] Patent Number: 5,933,045

[45] Date of Patent: Aug. 3, 1999

[54] RATIO CORRECTION CIRCUIT AND METHOD FOR COMPARISON OF PROPORTIONAL TO ABSOLUTE TEMPERATURE SIGNALS TO BANDGAP-BASED SIGNALS

[75] Inventors: Jonathan Audy, San Jose, Calif.; A. Paul Brokaw, Burlington, Mass.; Evaldo Miranda, San Jose; David Thomson, Fremont, both of Calif.

[73] Assignee: Analog Devices, Inc., Norwood, Mass.

[21] Appl. No.: 08/798,518

[22] Filed: Feb. 10, 1997

[51] Int. Cl.[6] ..... G05F 1/10; G05F 3/16

[52] U.S. Cl. ..... 327/513; 323/313

[58] Field of Search ..... 327/378, 512, 327/513, 530, 535, 538, 539–546; 323/313, 316

[56] References Cited

U.S. PATENT DOCUMENTS

| | | | |
|---|---|---|---|
| 4,808,908 | 2/1989 | Lewis et al. | 212/313 |
| 5,241,261 | 8/1993 | Edwards et al. | 323/313 |
| 5,352,973 | 10/1994 | Audy | 323/313 |
| 5,519,354 | 5/1996 | Audy | 327/539 |
| 5,592,111 | 1/1997 | Wong et al. | 327/45 |
| 5,614,816 | 3/1997 | Nahas | 327/539 |
| 5,619,163 | 4/1997 | Koo | 327/539 |

OTHER PUBLICATIONS

Donald G. Fink and Donald Christiansen, Editors, "Integrated Circuits and Microprocessors", *Electronics Engineers' Handbook*, Third Edition, 1989, pp. 8–48 through 8–50.

Alan B. Grebene, "Bias Circuits", *Bipolar and MOS Analog Integrated Circuit Design*, John Wiley & Sons, pp. 206–209.

*Primary Examiner*—My-Trang Nu Ton

*Attorney, Agent, or Firm*—Koppel & Jacobs

[57] ABSTRACT

A comparison system compares a voltage which is proportional to absolute temperature $S_p$ to one which is equal to the sum of a conventional, uncorrected, bandgap cell voltage VBG and a proportional to absolute temperature voltage CT. The addition of CT to the uncorrected bandgap signal value yields a signal of the form Sp/(VBG+CT), which exhibits improved linearity over a signal of the form Sp/VBG, where VBG includes a Tln(T) term.

25 Claims, 6 Drawing Sheets

RATIO CORRECTION CIRCUIT AND METHOD FOR COMPARISON OF PROPORTIONAL TO ABSOLUTE TEMPERATURE SIGNALS TO BANDGAP-BASED SIGNALS

BACKGROUND OF THE INVENTION

1. Field of the Invention

This invention relates to the comparison of proportional to absolute temperature signals to bandgap-based reference signals, and more particularly to reducing errors due to the T+Tln(T) deviation from linearity exhibited by bandgap references.

2. Description of the Related Art

The base-emitter voltage $V_{be}$ of a forward biased transistor is a linear function of absolute temperature T in degrees Kelvin (°K.), and is known to provide a stable and relatively linear temperature sensor:

$$V_{be} = \frac{kT}{q}\ln\left(\frac{I_c}{A_e Is}\right) \tag{1}$$

where k is Boltzmann's constant, T is the absolute temperature, q is the electron charge, $I_c$ is the collector current, $A_e$ is the emitter area, and $J_s$ is the saturation current density. Proportional to absolute temperature (PTAT) sensors eliminate the dependence on collector current by using the difference $\Delta V_{be}$ between the base emitter voltages $V_{be1}$ and $V_{be2}$ of two bipolar transistors that are operated at a constant ratio between their emitter current densities to form the PTAT voltage. Emitter current density is conventionally defined as the ratio of the collector current to the emitter size (this ignores the second order base current).

The basic PTAT voltage is given by:

$$\Delta V_{be} = V_{be1} - V_{be2} \tag{2}$$

$$\Delta V_{be} = \left(\frac{kT}{q}\right)\ln\left(\frac{I_{c1}A_{c2}}{I_{c2}A_{c1}}\right) \tag{3}$$

The basic PTAT voltage is amplified so that its sensitivity to changes in absolute temperature, can be calibrated to a desired value, suitably 10 mV/°K., and buffered so that a PTAT voltage can be read out without corrupting the basic PTAT voltage.

Such basic PTAT signals are often used as an indicator of the circuit's temperature. The PTAT signal is compared to a reference signal in order to convert the signal from a voltage representation of temperature to one of degrees, yielding a ratio of a PTAT signal to a reference signal. For example, the PTAT signal, e.g. a voltage, may be converted from analog to digital form by an analog to digital converter (ADC) which provides a digital output signal corresponding to the PTAT signal's percentage of the ADCs full scale analog input.

FIGS. 1A and 1B illustrate such a comparison graphically. In FIG. 1A PTAT and ideal, linear, reference signals in, respectively labelled VPTAT and VREF, are plotted against temperature in degrees Celsius. The result of the comparison is illustrated in FIG. 1B, which plots the ratio of VPTAT to VREF versus temperature. The output of an ADC would, naturally, occupy discrete locations along this line which, like the signal VPTAT, is also proportional to absolute temperature. Additionally, ADCs, which often employ regular equal-sized steps, would provide correspondingly regularly spaced output signals. If the reference or PTAT signal were nonlinear, their ratio would also be nonlinear, and the ADC's regular step sizes would lead to temperature measurement errors. To demonstrate the errors that may occur due to nonlinear bandgap voltages, an uncorrected bandgap voltage and a PTAT voltage are plotted versus temperature in FIG. 2A. The resultant ratio VBG/VPTAT is plotted in FIG. 2B, with the ratio's deviation from linearity exaggerated for illustrative purposes.

Bandgap reference circuits have been developed to provide a stable voltage supply that is insensitive to temperature variations over wide temperature range. These circuit operate on the principle compensating the negative temperature drift of a bipolar transistor's base emitter voltage ($V_{be}$) with the positive temperature coefficient of the thermal voltage $V_T$, which is equal to kT/q. A known negative temperature drift associated with the $V_{be}$ is first generated. A positive temperature drift due to the thermal voltage is then produced, and scaled and subtracted from the negative temperature drift to obtain a nominally zero temperature dependence. Numerous variations in the bandgap reference circuitry have been designed, and are discussed for example in Grebene, *Bipolar and MOS Analog Integrated Circuit Design,* John Wiley and Sons, 1984, pages 206 through 209, and in Fink et al, Ed. *Electronics Engineer's Handbook,* third edition, McGraw Hill Book Company, 1989, pages 8.48 through 8.50.

Although the output of a bandgap voltage cell is ideally independent of temperature, the outputs of uncorrected cells have been found to include a term that varies with T−Tln(T). Such an output deviation may yield a bandgap voltage output ($V_{bg}$) which increases from a value of about 1.2408 volts at −50° C. to about 1.244 volts at about 45° C., and then returns to about 1.2408 volts at 150° C. This output deviation is not symmetrical; its peak is skewed about 5° C. below the midpoint of the temperature range.

It is difficult to precisely compensate for the temperature deviation electronically, so simpler approximations have been used. One such circuit, described in U.S. Pat. No. 4,808,908 to Lewis et al. assigned to Analog Devices, Inc., the assignee of the present invention, employs a high thermal coefficient of resistance resistor to produce a voltage which is proportional to $T^2$. This square law voltage approximately cancels the effect of the temperature deviation. Another compensation circuit is described in U.S. Pat. No. 5,352,973 to Audy, assigned to Analog Device, Inc. This circuit provides precise compensation for the Tln(T) deviations but increases the complexity and cost of the basic bandgap cell.

Although conventional bandgap compensation schemes such as the square law compensation of U.S. Pat. No. 4,808,908 or the T+Tln(T) correction scheme of U.S. Pat. No. 5,352,973 may be employed to reduce PTAT/VBG nonlinearity by counteracting that of VBG, these compensation schemes require added cost and increase the complexity of comparison circuits.

SUMMARY OF THE INVENTION

The invention seeks to reduce the nonlinearity of ratios formed by a comparison of PTAT voltage signals to bandgap-based reference signals without significantly adding to the cost or complexity of either the bandgap-based or PTAT signal generation circuits.

These coals are achieved by linearizing the ratio of PTAT voltage signal to bandgap voltage signal through the generation and addition of PTAT signals to the conventional bandgap signal. Sufficient PTAT voltage is added so that the resultant ratio, e.g., $S_p/(VBG+C_p)$, where $S_p$ is a PTAT signal to be compared to a voltage reference, VBG is a conventional bandgap voltage signal, and $C_p$ is a PTAT correction signal, is substantially more linear than the conventional ratio, i.e., $S_p/VBG$.

The PTAT correction signal $C_p$ is preferably generated by employing a component such as a resistor whose value differs from one that would be employed in a conventional bandgap circuit. That is, since a conventional bandgap voltage is generally produced by adding enough PTAT voltage to a CTAT voltage to produce an output voltage equal to the bandgap voltage of the transistors employed, a different resistor value, current ratio, ratio of emitter areas, etc., may be employed to produce a greater PTAT voltage for addition to the CTAT voltage.

The component values are determined by selecting a value of C such that the ratio of PTAT signal to de-tuned bandgap signal equals the ratio of the PTAT signal to uncorrected bandgap signal at the extremes of the temperature range of interest and to the value at one point on a line between these endpoints. In a preferred embodiment, C is selected so that the resulting ratio Sp/VBG' equals the value of this projected ratio at the midpoint of the temperature range.

These and other features and advantages of the invention will be apparent to those skilled in the art from the following detailed description, taken with the accompanying drawings.

DETAILED DESCRIPTION OF THE INVENTION

Figure 1B:
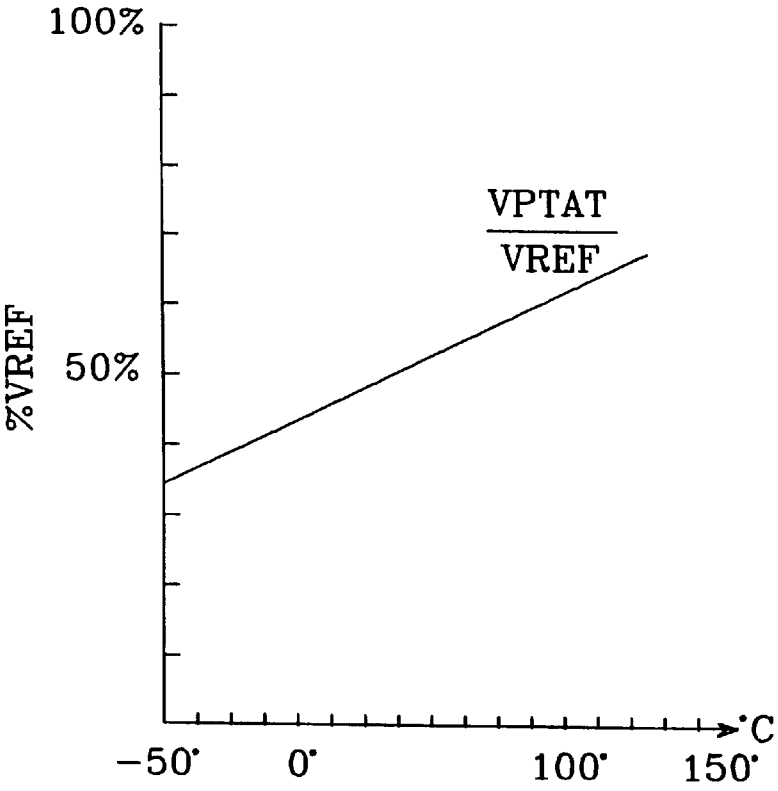
FIG. 1B (Prior Art)
FIG. 1B is a graph of the ratio of a PTAT voltage signal to an ideal reference voltage versus temperature.
Figure 1A:
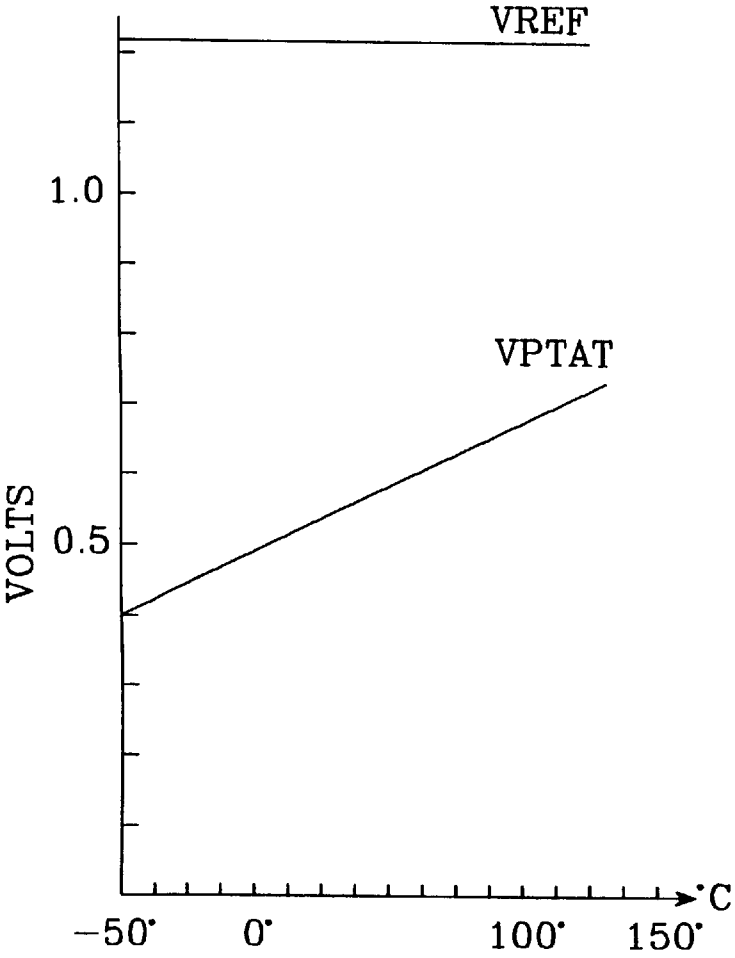
FIG. 1A (Prior Art)
FIG. 1A is a graph which plots an ideal reference voltage Vref and a proportional to absolute temperature voltage VPTAT against temperature.
Figure 2B:
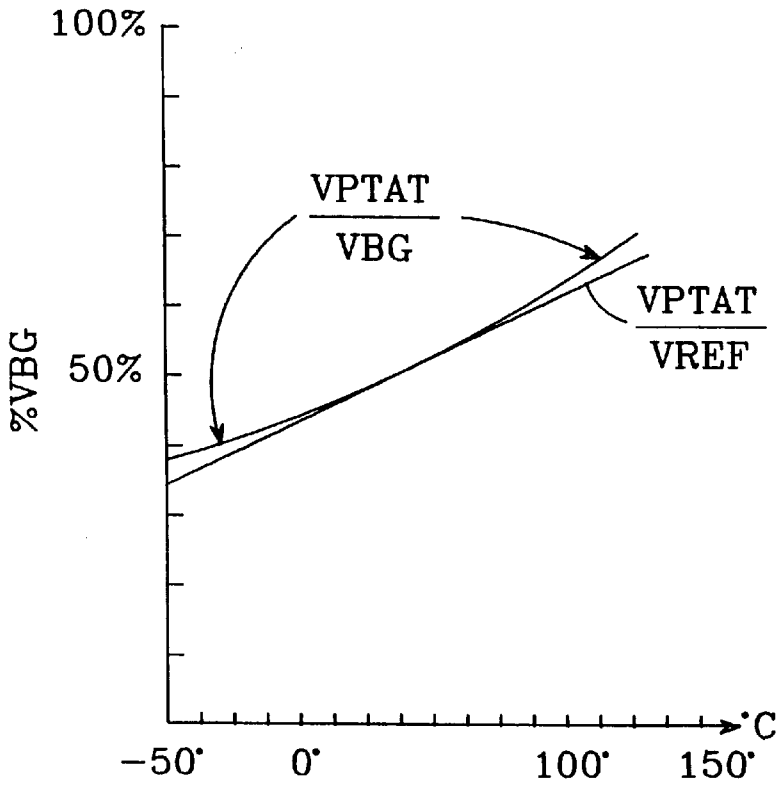
FIG.2B (Prior Art)
FIGS. 2A and 2B are respective graphs of uncorrected bandgap reference voltage and PTAT voltages versus temperature and of the ratios of PTAT voltage to an uncorrected bandgap and an ideal reference voltage.
Figure 2A:
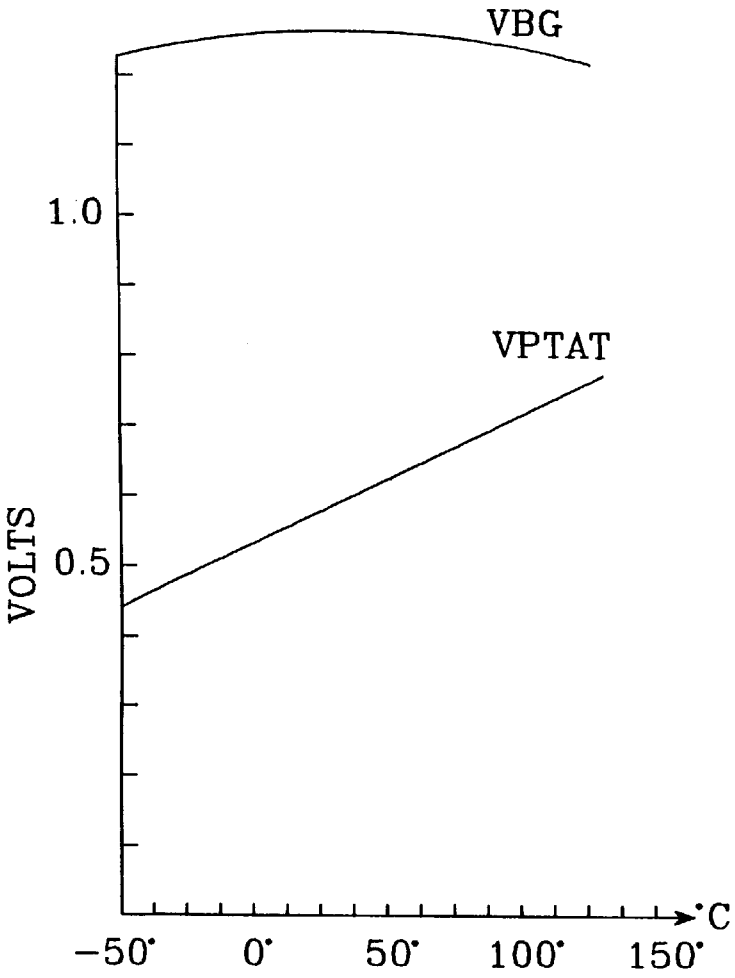
FIG.2A (Prior Art)
Figure 3:
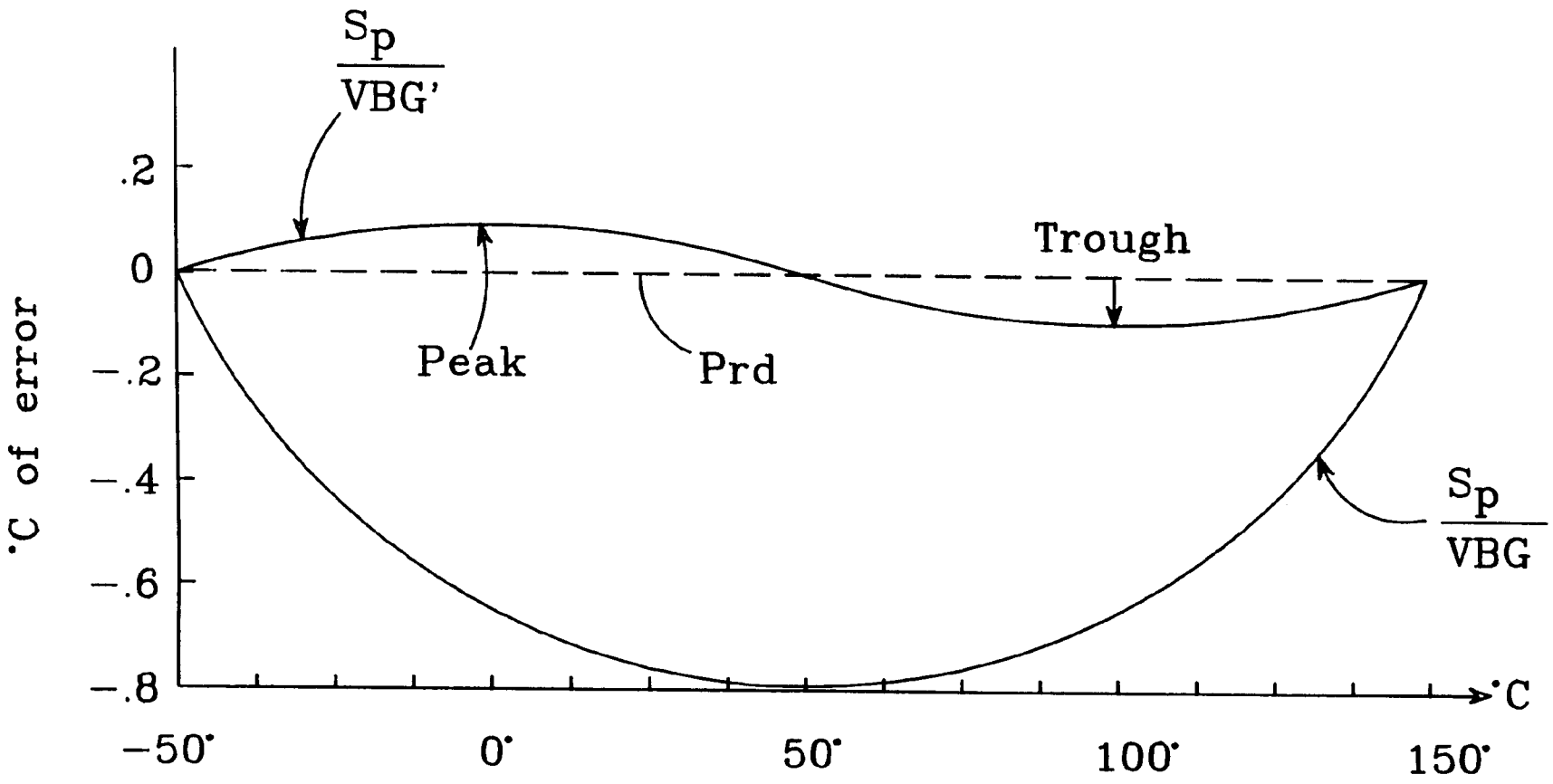
FIG. 3 is a graph of nonlinearity error versus temperature for a ratio of PTAT signal to de-tuned bandgap voltage Sp/VBG' and for PTAT signal to an uncorrected bandgap voltage Sp/VBG.

As shown in FIG. 3, the present invention provides a comparison circuit which generates an output $S_p/VBG'$, where Sp is a PTAT signal and VBG' is a de-tuned bandgap signal of the form VBG+CT, where VBG is an uncorrected bandgap signal and CT is a PTAT correction voltage. The new comparison circuit exhibits considerably less nonlinearity than conventional comparison circuits which generate an output $S_p/VBG$. The signal VBG' is a "de-tuned" bandgap voltage signal, i.e., VBG' is produced by adding more PTAT signal to a CTAT signal than would normally be done to produce a conventional bandgap signal. Consequently, unlike an uncorrected bandgap signal VBG, VBG' does not equal the bandgap voltage of the material from which the transistors which produce the signal are made. De-tuning the bandgap cell in this fashion produces a comparison ratio with a nonlinearity curve which has a sideways "S" shape, unlike the parabolic shaped nonlinearity curve produced by comparing a PTAT signal to an uncorrected bandgap signal VBG. A line labeled Prd is projected between the values of $S_p/VBG$ at the extremes of the temperature range and is, like the ideal ratio VPTAT/VREF, linear and proportional to absolute temperature. The best overall error performance is obtained from the new comparison circuit by adding enough PTAT signal to the uncorrected bandgap signal VBG so that the line representing $S_p/VBG'$ crosses the projected line PRD at the midpoint of the temperature range, 50 C in this example. This "zero crossing" may be shifted to lower or higher temperatures by adding more or less PTAT signal, respectively, to the uncorrected bandgap signal. With the zero crossing at mid-range the peak and trough of the error signal are approximately equal. Shifting the zero crossing to higher temperatures increase the peak while reducing the trough and shifting the zero crossing to lower temperatures reduces the peak and increases the trough.

Figure 4:
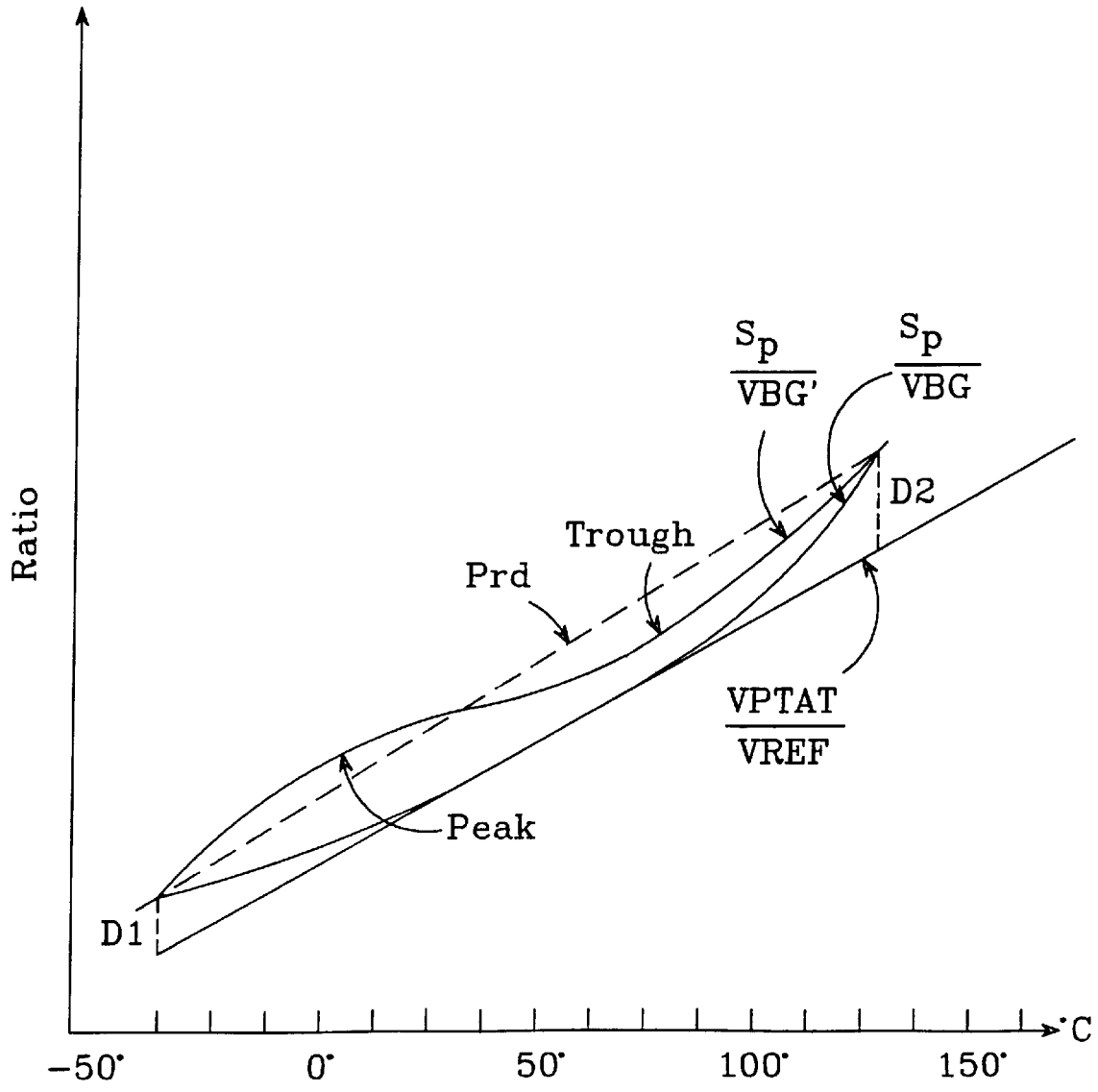
FIG. 4 is a graph of the ratio of an ideal PTAT to ideal reference voltage VPTAT/VREF, a PTAT to uncorrected bandgap reference voltage ratio Sp/VBG, a new ratio of PTAT to de-tuned VBG' ratio Sp/VBG', where VBG' is a bandgap voltage plus PTAT voltage according to the invention, and a line projected between the endpoints of the Sp/VBG at the extremes of the temperature range of interest.

FIG. 4 illustrates, in greater detail, the derivation of the error terms in FIG. 3. Curves representing ideal, uncorrected, and corrected ratios, $VPTAT/V_{REF}$, $S_p/VBG$, and $S_p/VBG'$ are plotted against temperature, with the nonlinearities exaggerated for illustrative purposes. The error curves of FIG. 3 are derived from FIG. 4 by projecting a line through the values of $S_p/VBG$ at the extremes of the temperature range of interest, negative 50 and 150° Celsius in this case. This line, also PTAT, is also an ideal, linear, PTAT ratio. The error FIG.s of FIG. 3 are simply deviations from this projected line which are rotated for convenient viewing.

Since the new comparison circuits produce a signal $S_p/VBG'$ which equal $S_p/(VBG+cT)$,c is selected so that the error curve for $S_p/VBG'$ presents the sideways S of FIG. 3, preferably with the zero crossing at 50° Celsius. The selection process may be carried out for a given circuit using a mathematical simulation and adjusting the value of c until the zero crossing of the error curve is at the midpoint of the temperature range of interest, or, alternatively, the peak and trough of the error function extend equal distances from the projected PTAT ratio line. Component values which correspond to the values of Sp and C are used in the comparison circuits.

In the following explanation of the method for determining an appropriate value for C, it is assumed that the comparison circuit includes a de-tuned bandgap cell. The de-tuned cell may be implemented in the same manner as conventional bandgap cells, with a substitution of component values. For example, one implementation of bandgap cells includes a pair npn transistors that conduct different current densities to establish a $\Delta V_{be}$, PTAT, signal. Typically the PTAT signal is established by operating transistors having emitter areas of ratio A at identical current levels. The PTAT signal appears across one resistor and is added to a CTAT provided by the base-emitter voltage of transistor. With conventional trimming, the cell output voltage equals the bandgap energy $E_g$ of the material from which the transistors are formed. The output for such an uncorrected bandgap cell VBG is given by the known equation for a conventional bandgap cell:

$$VBG = E_g - (E_g - V_{beA})\frac{T}{T_{ref}} - (\sigma - 1)\frac{kT}{q}\ln\left(\frac{T}{T_{ref}}\right) + \frac{2R_2}{R_1}\frac{kT}{q}\ln(A) \tag{4}$$

where $V_{beA}$ is the base emitter voltage at an arbitrary reference temperature $T_{ref}$ of the transistor whose emitter area is A times that of the other transistor, T is the operating temperature, $\partial$ is the saturation current temperature exponent (referred to as XTI in the SPICE® circuit simulation program developed by University of California at Berkeley, and equal to 3.0 for diffused silicon junctions). In the new de-tuned bandgap cell, component values, typically resistor values, are selected so that the de-tuned cell output voltage VBG' is greater than the bandgap energy $E_g$.

An offset term is sometimes added to the basic PTAT Kelvin temperature signal in order to optimize the variation of the sensor's output over the desired temperature range of operation. In most cases this offset voltage will also be some multiple of a bandgap voltage (of the form Vbe+VPTAT), and hence will also contain the nonlinear Tln(T) term. However, adding the offset term to the basic PTAT temperature signal does not alter the basic form of the comparison function. Thus, the linearity improvement holds, even if an offset voltage is employed. This indifference to the addition of offset voltages may be seen using partial fraction expansion of a corrected comparison signal having an offset. A corrected comparison signal without offset may be written:

$$\text{comp} = \frac{GT}{(cT + VBG)} \tag{5}$$

where VBG is the voltage of an uncorrected bandgap circuit. The addition of an offset may be expressed as follows:

$$\text{Comp + Offset} = \frac{(GT - D(VBG))}{(cT + VBG)} \tag{6}$$

where the multipliers c, D' and G are constants. Using a partial fraction expansion this expression may be written:

$$\text{Comp + Offset} = -D' + \frac{(G + cD')T}{(cT + VBG)} \tag{7}$$

This expression is of the same form as the comparison signal without offset. Thus, the linearity improvement is unaffected by the addition of a bandgap voltage offset to the numerator.

The non-linearity occurs in the core function, T/(cT+DVBG) and this function determines the optimized value for "c", the nonlinearity correction factor. The gain term "G" and the offset term D'·VBG have no effect on this core term, so different values for "G" and "D'" may be used without altering the value of "c".

In a given circuit if is desirable to trim the effective values of "c", "G" and "D'" to get the desired curvature correction, offset, and gain. If these factors were inter-dependent, it would make trimming difficult, at best. Therefore, there is considerable benefit in the fact that trimming "G" or "D'" does not alter the previously trimmed value of "c". Additionally, "G" can be trimmed after trimming "D'" so that no interaction occurs between curvature correction, offset, or gain terms. The computed value for "c" is therefore independent of specific circuit embodiment and only depends upon transistor model parameters (primarily SPICE model parameters EG and XTI) and the temperature range over which optimization is desired.

In order to derive the function for "c", the PTAT temperature signal is expressed as a function of temperature:

$$S_p = (G)(T) + (D')(VBG)(T) \tag{8}$$

or $$S_p(T) = GT + D \tag{9}$$

where G is the PTAT temperature coefficient, D is a typically negative temperature offset value with the , Sp(T) indicates that Sp is a function of T, absolute temperature. Addition of the offset D does not change the basic form of the comparison ratio, and hence the linearity improvement of the new circuit applies even when an offset is added to the basic PTAT temperature signal.

The corrected comparison ratio SD' may be written:

$$SD'(T) = \frac{S_p(T)}{VBG'(T)} = \frac{S_p(T)}{VBG(T) + c(T)} \tag{10}$$

By equating the mid-range error to that at the lowest temperature in the range, a zero crossing of the error signal at the desired mid-range temperature is set:

$$\frac{S_p(-50)}{VBG(-50) + (c)(-50)} - \frac{(SD'(150) - SD'(-50))(-50)}{150 - (-50)} = \frac{S_p(50)}{VBG(50) + (c)(50)} - \frac{(SD'(150) - SD'(-50))(50)}{150 - (-50)} \tag{11}$$

where $S_p(-50)$ indicates the value of the function Sp at −50° Celsius, the lower end of the temperature range in this example, and (C) (−50) indicates the product of C and −50. Collecting terms yields:

$$0 = \frac{S_p(-50)}{VBG(-50) + (c)(-50)} - \frac{S_p(50)}{VBG(50) + (c)(50)} - \frac{(SD'(150) - SD'(-50))(50 + 50)}{150 - (-50)} \tag{12}$$

keeping in mind that SD' includes a term involving C, equation 8 includes C in many terms. A transcendental equation such as this is susceptible to solution with an iterative root solver, available in many mathematical software programs:

$$C = \text{root}\left[\left[\frac{S_p(-50)}{VBG(-50)+(c)(-50)} - \frac{S_p(50)}{VBG(50)+(c)(50)} + \frac{\left(\frac{S_p(150)}{VBG(150)+(c)(150)}\right) - \left(\frac{S_p(-50)}{VBG(-50)+(c)(-50)}\right)(50+50)}{150-(-50)}\right], c\right] \tag{13}$$

A further simplification may be made. The values of "G" and "D" within the function Sp(T) can be set to zero and Sp(T) collapses to "T". This simplification is possible because, as was demonstrated above, the calculation "c" is independent of "G" and "D".

$$c = \text{root}\left[\left[\frac{T_1}{VBG(T_1)+cT_1} - \frac{T_2}{VBG(T_2)+cT_2} + \left(\frac{\left(\frac{T_3}{VBG(T_3)+cT_3}\right) - \frac{T_1}{VBG(T_1)+cT_1}}{T_3-T_1}\right)(T_2-T_1)\right], c\right] \tag{14}$$

using the iterative root solver of equation 14 one obtains the value of $8.948*10^{-5}$ for C assuming the following values:

A=10

R2=$2.735*10^{-5}$

R1=$5.829*10^{4}$ $T_{ref}$=323.15

$V_{beA}$=0.623

G=$5*10^{-3}$

D=1 the function which yields the sideways S curve for $S_p$/VBG' is obtained by rotating the curve labelled $S_p$/VBG' in FIG. 4 about its minimum endpoint to the horizontal and converting the percentage error (deviation from the projected line labelled prd) to an error in degrees Celsius. This is accomplished by dividing the difference between the rotated value at T and the rotated value at the minimum temperature by the temperature coefficient of the uncorrected ratio. That is:

$$S_p(T)/VBG'(T)\text{error} = \frac{SD'(t) - \left(\frac{SD'(T_3)-SD'(T_1)}{T_3-T_1}\right)^T - SD'(T_1)\left(\frac{SD'(T_3)-SD'(T_1)}{T_3-T_1}\right)^T}{tempco} \tag{15}$$

where minimum, midpoint, and maximum temperatures in the range are denoted T1, T2 and T3 respectively and the temperature coefficient is given by:

$$tempco = \frac{\frac{S_p(T_3)}{VBG(T_3)} - \frac{S_p(T_1)}{VBG(T_1)}}{T_3-T_1} \tag{16}$$

Use of the new de-tuned bandgap cell in comparison circuits typically reduces the error, in degrees Celsius, by approximately an order of magnitude, permitting accuracy of ±0.08° Celsius, as opposed to errors of ±0.8° Celsius in a comparison circuit which employs an uncorrected bandgap cell.

Figure 5:
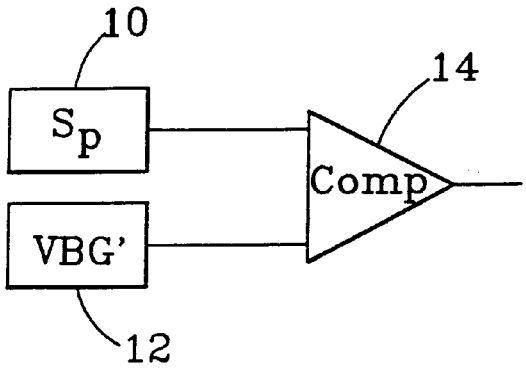
FIG. 5 is a block diagram of a comparison circuit which incorporates the new ratio linearization.

The block diagram of FIG. 5 illustrates the basic combination of PTAT signal circuit 10, a de-tuned bandgap cell 12 and a comparison circuit 14. Since the PTAT circuit 10 yields a PTAT signal and the de-tuned bandgap circuit yields a signal equal to VBG+CT, comparison of the two signals by the comparator 14 produces an output signal of the form VPTAT/(VBG+CT) which, with proper choice of the constant C, and corresponding circuit components, is substantially more linear than a ratio of the form VPTAT/VBG.

Figure 6:
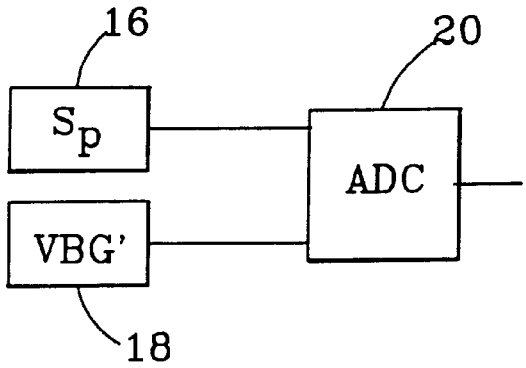
FIG. 6 is a block diagram of an analog to digital converter implementation of the comparison circuit of FIG. 4.

One form of comparison, analog to digital conversion of a PTAT signal, is illustrated in the block diagram of FIG. 6. A PTAT signal $S_p$ developed by a PTAT signal generation circuit 16 is compared to a signal VBG' produced by a novel de-tuned bandgap circuit 18. An analog to digital converter 20 produces a digital output signal corresponding to the ratio $S_p$/VBG'. It should be noted that, although the de-tuned circuit 18 may be physically implemented as a separate circuit from that of the PTAT generation circuit, the ratio of the two determines the proper value for C.

Figure 7:
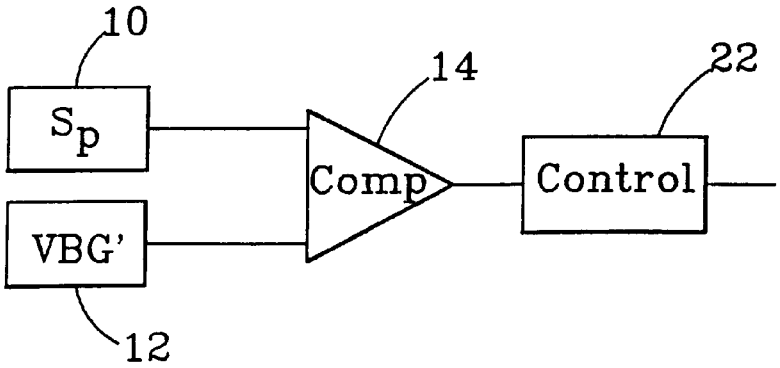
FIG. 7 is a block diagram of the comparison circuit of FIG. 4 used in conjunction with control circuitry.

The new comparison circuit may also be used in a control circuit, as illustrated by the block diagram of FIG. 7. The PTAT 10, de-tuned bandgap 12 and comparison circuits are the same as like-named circuits of FIG. 5. Control circuit 22 is connected to receive the output of the comparison circuit 14. The control circuit may employ the comparison circuit output, a linear PTAT signal with improved linearity, to set a temperature trip point in a process control system, for example.

Figure 8:
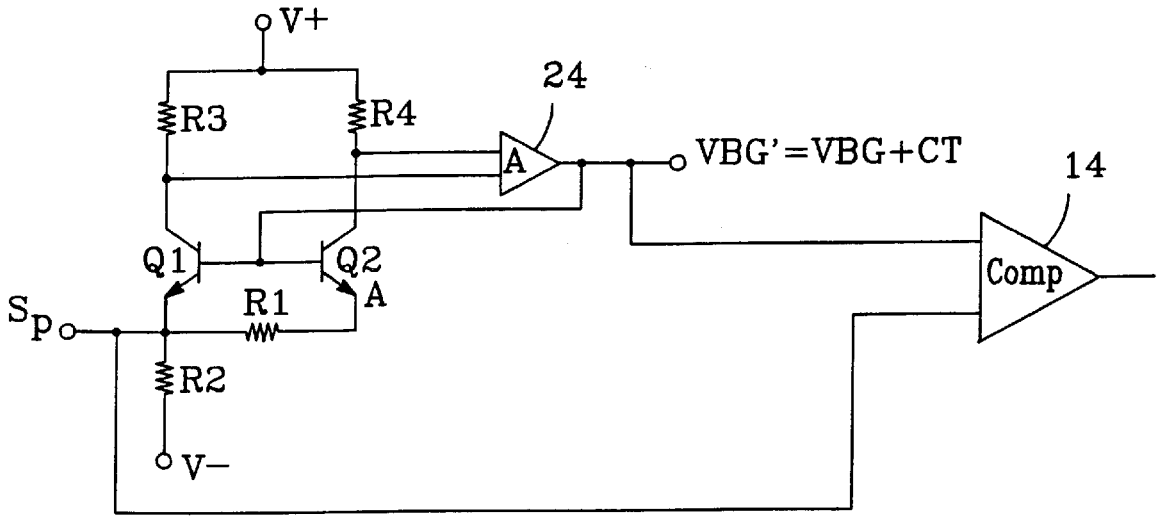
FIG. 8 is a circuit diagram of one implementation of the new ratio linearization circuitry.
Figure 9:
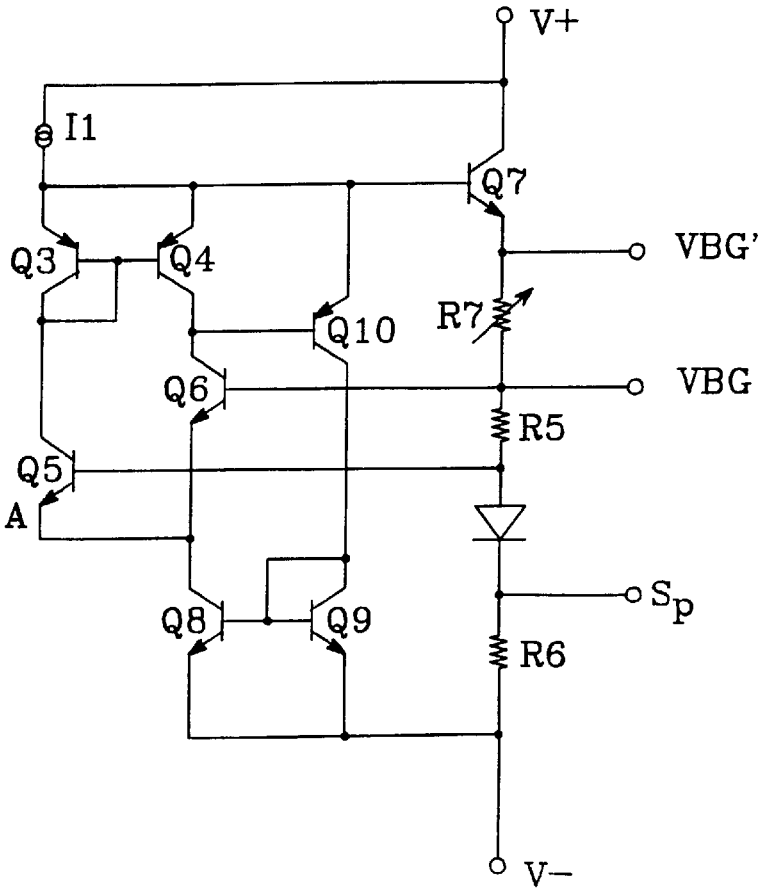
FIG. 9 is a circuit diagram of an alternative implementation of the new ratio linearization circuitry.

One embodiment of the novel de-tuned bandgap cell is illustrated in the schematic of FIG. 8. Equal collector currents are forced through npn transistors Q1 and Q2 which are joined at their respective bases. The emitter area of Q2 is A times that of emitter area of transistor Q1. Since equal currents are forced through the transistors and their bases are tied together, the difference in their base-emitter voltages will appear across a resistor R1 which is connected between the respective emitters of transistors Q1 and Q2. A resistor R2 connected between the emitter of Q1 and a negative supply terminal conducts the PTAT current established across resistor R1 to the negative supply terminal V−.

Since the transistor's collector currents are equal and that of transistor Q2, established by the $\Delta V_{be}$ between transistors Q1 and Q2, is PTAT, that of Q1 will also be PTAT. Consequently, the total voltage across resistors R1 and R2 will be PTAT and, added to the CTAT due to the base-emitter voltage of transistor Q2, will produce a voltage output VBG' at the terminal of the same name and a PTAT signal Sp at a terminal Sp formed at the junction of resistors R1 and R2. Additionally the resistors are trimmed so that a voltage greater than the bandgap energy $E_g$ appears at the bases of transistors Q1 and Q2. This signal connected to a terminal labelled VBG' is the de-tuned bandgap signal. That is it is equal to VBG+cT. With R2 chosen so that R2−ΔR yields an uncorrected bandgap signal at the bases of transistors Q1 and Q2, ΔR multiplied by the PTAT current flowing through R2 equals the product CT.

An operational amplifier 24 has its inverting and noninverting inputs connected to the collectors of transistors Q1 and Q2 respectively. Equal valued resistors R3 and R4 are connected between a positive supply terminal V+ and collectors of transistors Q1 and Q2 respectively thus establishing equal collector currents for transistors Q1 and Q2. The PTAT signal $S_p$ and detuned bandgap signal VBG' are compared by the comparison circuit 14, which may take the form of an ADC or other comparison circuits such as a simple comparator (sometimes referred to as a one-bit ADC).

FIG. 8 is a schematic diagram of another novel circuit which produces PTAT and de-tuned bandgap signals, Sp and VBG" respectively. A current source I1 is connected between a positive supply V+ and the emitters of PNP transistors Q3 and Q4, which are connected to form a current mirror. A pair of NPN transistors Q5 and Q6 are respectively connected through their collectors those of transistors Q3 and Q4, and are therefore supplied equal currents from transistors Q3 and Q4. The emitter area of transistor Q5 is A times that of transistor Q6 and the emitters of transistors Q5 and Q6 are connected together, consequently, a PTAT voltage, the difference between their base-emitter voltages, appears across a resistor R5 connected between their respective bases. This forces a PTAT current through a diode D1 connected in series with a resistor R6 between the emitter of Q5 and a negative supply terminal $V^-$. The current through resistor R6 is also PTAT and the voltage across R6 is a PTAT voltage Sp which may be employed as a temperature measurement signal.

The diode voltage is CTAT and, when added to the PTAT voltages appearing across appropriately-valued resistors R5 and R6, produces a conventional uncorrected bandgap voltage VBG at the base of Q6. A resistor R7 is connected between the emitter of an NPN transistor Q7, connected at its collector to the positive supply terminal and at its base to the emitters of Q3 and Q4, and the base of Q6. The current through R7 is PTAT and the addition of the voltage across R7 to that at the base of Q6 produces a signal of the form VBG+CT, where CT is produced by the product of R7 and the current through R7. Resistor R7 may therefore be adjusted to produce the desired value for CT, yielding the de-tuned bandgap voltage VBG' at the emitter of transistor Q7. A current mirror formed of NPN transistors Q8 and Q9 force half the current I1 through Q3 and Q4 and the other half through a PNP transistor Q10 which clamps the voltage across transistor Q4.

While particular embodiments of the invention have been shown and described, numerous variations and alternate embodiments will occur to those skilled in the art. Accordingly it is intended that the invention be limited only in terms of the impended claims.

We claim:

1. A temperature measurement system, comprising:

a de-tuned bandgap circuit, including circuitry which generates proportional to absolute temperature (PTAT) and complementary to absolute temperature (CTAT) signals and combines said PTAT and CTAT signals, said PTAT signal being of sufficient magnitude to render the combination of said PTAT and CTAT signals, VBG', a PTAT signal which is greater than the bandgap energy at absolute zero Eg, a proportional to absolute temperature signal generation circuit connected to produce an output signal $S_p$ which is proportional to absolute temperature (PTAT), and a comparison circuit connected to compare said PTAT signal $S_p$ to said de-tuned bandgap signal VBG', thereby producing a comparison signal SD' of the form $S_p$/VBG', said de-tuned bandgap circuit and said PTAT generation circuit arranged such that said comparison signal varies nearly linearly with temperature over a pre-determined temperature range.

2. A temperature measurement system, comprising:

a de-tuned bandgap circuit, including circuitry which generates proportional to absolute temperature (PTAT) and complementary to absolute temperature (CTAT) signals and combines said PTAT and CTAT signals, said PTAT signal being of sufficient magnitude to render the combination of said PTAT and CTAT signals, VBG', a PTAT signal which is greater than the bandgap energy at absolute zero Eg, a proportional to absolute temperature signal generation circuit connected to produce an output signal $S_p$ which is proportional to absolute temperature (PTAT), and a comparison circuit connected to compare said PTAT signal $S_p$ to said de-tuned bandgap signal VBG', thereby producing a comparison signal SD' of the form $S_p$/VBG', said de-tuned bandgap circuit and said PTAT generation circuit arranged such that said comparison signal varies nearly linearly with temperature over a pre-determined temperature range, wherein sufficient PTAT signal is added such that a plot of the nonlinearity of said comparison signal forms an S-shaped curve.

3. The temperature measurement system of claim 2, wherein the end-points of said nonlinearity curve corresponding to the temperature extremes of said temperature range substantially coincide with the endpoints of a plot of the nonlinearity of a comparison of said PTAT signal Sp and an uncorrected bandgap signal VBG.

4. The temperature measurement system of claim 3, wherein the amount of PTAT signal added is less than the amount required to render said nonlinearity curve parabolic.

5. The temperature measurement system of claim 4, wherein the amount of PTAT signal added produces an S-shaped nonlinearity curve with a zero-crossing at approximately the middle of the comparison circuit's temperature range.

6. The temperature measurement system of claim 4, wherein the amount of PTAT signal added produces and S-shaped nonlinearity curve with a peak and a trough of equal magnitude.

7. The temperature measurement system of claim 4, wherein the PTAT signal combined with a CTAT signal to produce the de-tuned band gap output VBG' is also connected to produce the PTAT signal Sp which is compared to said de-tuned band gap output VBG' by said comparison circuit to produce said temperature comparison output SD'.

8. The temperature measurement system of claim 2, wherein said comparison circuit comprises a comparator.

9. The temperature measurement system of claim 2, wherein said comparison circuit comprises an analog-to-digital converter (ADC).

10. A comparison system, comprising:

a de-tuned bandgap reference circuit connected to produce a PTAT reference voltage of the form VBG+CT which is greater than the bandgap energy at absolute zero Eg, where VBG is a bandgap voltage produced by an uncorrected bandgap circuit, C is a constant, and T is the temperature of the circuit in degrees Kelvin, a signal generation circuit connected to produce a PTAT signal Sp, and a comparison circuit connected to compare said PTAT and reference voltages to produce a comparison signal of the form Sp/(VBG+CT), said de-tuned bandgap circuit and said PTAT generation circuit arranged such that said comparison signal varies nearly linearly with temperature over a pre-determined temperature range.

11. A comparison system, comprising:

a de-tuned bandgap reference circuit connected to produce a PTAT reference voltage of the form VBG+CT which is greater than the bandgap energy at absolute zero Eg, where VBG is a bandgap voltage produced by an uncorrected bandgap circuit, C is a constant, and T is the temperature of the circuit in degrees Kelvin, a signal generation circuit connected to produce a PTAT signal Sp, and a comparison circuit connected to compare said PTAT and reference voltages to produce a comparison signal of the form Sp/(VBG+CT), said de-tuned bandgap circuit and said PTAT generation circuit arranged such that said comparison signal varies nearly linearly with temperature over a pre-determined temperature range, wherein the constant C is great enough to yield a plot of the nonlinearity of said comparison signal which forms and S-shaped curve.

12. The comparison system of claim 11, wherein said system is designed to operate over a temperature range and the end-points of said nonlinearity curve, corresponding to the temperature extremes of this range, substantially coincide with the endpoints of a plot of the nonlinearity of a comparison of said PTAT signal Sp and an uncorrected bandgap signal VBG.

13. The comparison system of claim 12, wherein the constant C is insufficient to render the comparison system's nonlinearity curve parabolic.

14. The comparison system of claim 13, wherein the constant C has a value which produces an S-shaped nonlinearity curve for the comparison system, with a zero-crossing at approximately the middle of the comparison system's temperature range.

15. The comparison system of claim 14, wherein the constant C has a value which produces and S-shaped nonlinearity curve for the comparison system, with a peak and a trough of equal magnitude.

16. The comparison system of claim 15, wherein said comparison circuit comprises a comparator.

17. The comparison system of claim 15, wherein said comparison circuit comprises an analog-to-digital converter (ADC).

18. A comparison system, comprising:

a de-tuned bandgap reference circuit connected to produce a PTAT reference voltage of the form VBG+CT which is greater than the bandgap energy at absolute zero Eg, where VBG is a bandgap voltage Produced by an uncorrected bandgap circuit, C is a constant, and T is the temperature of the circuit in degrees Kelvin, a signal generation circuit connected to produce a PTAT signal Sp, and a comparison circuit connected to compare said PTAT and reference voltages to produce a comparison signal of the form Sp/(VBG+CT), said de-tuned bandgap circuit and said PTAT generation circuit arranged such that said comparison signal varies nearly linearly with temperature over a pre-determined temperature range, wherein said constant C establishes said comparison signal, Sp/(VBG+CT), equal to a comparison signal of an uncorrected bandgap circuit, Sp/VBG, at the lowest and highest temperatures of the comparison system's temperature range.

19. The comparison system of claim 18, wherein said constant C establishes said comparison signal, $[Sp/(VBG+CT)]|_{T1}=[Sp/Eg]|_{T1}+D1$ where $[Sp/(VBG+CT)]''_{T1}$ is the value of the comparison signal at the lowest temperature T1 of the comparison circuit's temperature range and $[Sp/Eg]|_{T1}$ is the value of a comparison between the PTAT signal Sp and a signal having a voltage equal to the bandgap energy Eg at the lowest temperature T1 of the comparison circuit's temperature range and D1 is a constant.

20. The comparison system of claim 19, wherein said constant C establishes said comparison signal, $[Sp/(VBG+CT)]|_{T3}=[Sp/Eg]|_{T3}+D2$ where $[Sp/(VBG+CT)]|_{T3}$ is the value of the comparison signal at the highest temperature T3 of the comparison circuit's temperature range and $[Sp/Eg]|_{T3}$ is the value of a comparison between the PTAT signal Sp and a signal having a voltage equal to the bandgap energy Eg at the highest temperature T3 of the comparison circuit's temperature range and D2 is a constant.

21. The comparison system of claim 20, wherein said constant C establishes said comparison signal, $[Sp/(VBG+CT)]|_{T2}=[Sp/Eg]|_{T2}+[(D2+D1)/2]$ where $[Sp/(VBG+CT)]|_{T2}$ is the value of the comparison signal at the mid-range temperature T2 of the comparison circuit's temperature range and $[Sp/Eg]|_{T2}$ is the value of a comparison between the PTAT signal Sp and a signal having a voltage equal to the bandgap energy Eg at the mid-range temperature T2 of the comparison circuit's temperature range.

22. A comparison system, comprising:

a de-tuned bandgap reference circuit, said reference circuit comprising:

a pair of bipolar transistors connected to operate at unequal current densities and to thereby establish a difference in base-emitter voltages ΔVbe, which is PTAT, said ΔVbe combined with a transistor's base-emitter voltage, which is CTAT, to produce a voltage VBG+CT which is a PTAT signal that is greater than the transistors' bandgap energy at absolute zero, a signal generation circuit connected to produce a PTAT signal Sp, and a comparison circuit connected to compare said PTAT and reference voltages to produce a comparison signal of the form Sp/(VBG+CT), said de-tuned bandgap circuit and said PTAT generation circuit arranged such that said comparison signal varies nearly linearly with temperature over a pre-determined temperature range.

23. A comparison system, comprising:

a de-tuned bandgap reference circuit, said reference circuit comprising:

a pair of bipolar transistors connected to operate at unequal current densities and to thereby establish a difference in base-emitter voltages ΔVbe, which is PTAT, said ΔVbe combined with a transistor's base-emitter voltage, which is CTAT, to produce a voltage VBG+CT which is a PTAT signal that is greater than the transistors' bandgap energy at absolute zero, a signal generation circuit connected to produce a PTAT signal Sp, and a comparison circuit connected to compare said PTAT and reference voltages to produce a comparison signal of the form Sp/(VBG+CT), said de-tuned bandgap circuit and said PTAT generation circuit arranged such that said comparison signal varies nearly linearly with temperature over a pre-determined temperature range, wherein the constant C is great enough to yield a plot of the nonlinearity of said comparison signal which forms an S-shaped curve.

24. The comparison system of claim 23, wherein said system is designed to operate over a temperature range and the end-points of said nonlinearity curve, corresponding to the temperature extremes of this range, substantially coincide with the endpoints of a plot of the nonlinearity of a comparison of said PTAT signal Sp and an uncorrected bandgap signal VBG.

25. The comparison circuit of claim 24, wherein said de-tuned band gap circuit includes:

a pair of equal-valued current sources, a pair of bipolar transistors having an emitter-area ratio A connected to receive equal collector currents from said current sources and connected together at their bases, a resistor R1 connected between the emitters of said transistors to establish a ΔVbe PTAT voltage, a resistor R2 connected between the emitter of the transistor whose emitter area is 1/A times that of the other transistor and a negative supply voltage terminal to establish an additional PTAT voltage Sp, said resistors having values such that the total PTAT voltage appearing across them exceeds the level of PTAT necessary to establish a voltage equal to the bandgap voltage Eg at the emitters of said transistors.

* * * * *